US008280292B2

(12) United States Patent
Mills, III et al.

(10) Patent No.: US 8,280,292 B2
(45) Date of Patent: Oct. 2, 2012

(54) METHOD REDUCING IMAGE GLOSSER ARTIFACTS

(75) Inventors: Borden H. Mills, III, Webster, NY (US); John L. Hryhorenko, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 459 days.

(21) Appl. No.: 12/378,089

(22) Filed: Feb. 11, 2009

(65) Prior Publication Data

US 2010/0201770 A1 Aug. 12, 2010

(51) Int. Cl.
*G03G 15/20* (2006.01)

(52) U.S. Cl. ..... 399/341

(58) Field of Classification Search ..... 399/296, 399/341, 342; 347/102, 155, 156; 430/124.13, 430/124.2, 126.1
See application file for complete search history.

(56) References Cited

U.S. PATENT DOCUMENTS

| | | | | |
|---|---|---|---|---|
| 5,842,099 | A | 11/1998 | Aslam et al. | |
| 6,101,345 | A * | 8/2000 | Van Goethem et al. | 399/341 |
| 6,512,914 | B2 * | 1/2003 | Kabashima | 399/341 |
| 7,024,148 | B2 * | 4/2006 | Uehara et al. | 399/341 |
| 7,024,149 | B2 * | 4/2006 | Kito et al. | 399/341 |
| 7,139,521 | B2 | 11/2006 | Ng et al. | |
| 7,236,734 | B2 | 6/2007 | Ng et al. | |
| 2007/0059066 | A1 * | 3/2007 | Fukatsu et al. | 399/341 |
| 2007/0280758 | A1 | 12/2007 | Ciaschi et al. | |

* cited by examiner

*Primary Examiner* — Sandra Brase
(74) *Attorney, Agent, or Firm* — Donna P. Suchy

(57) ABSTRACT

Often times the glossing process results in an image artifact consisting of locally lighter image a fixed distance from the lead edge as a print is glossed. This artifact is most visible in areas of medium but consistent image. The present invention provides methods for reducing this artifact.

10 Claims, 5 Drawing Sheets
(3 of 5 Drawing Sheet(s) Filed in Color)

METHOD REDUCING IMAGE GLOSSER ARTIFACTS

FIELD OF THE INVENTION

This invention relates to image printing. In particular, this invention relates to optimizing the finishing procedure of a printing process.

BACKGROUND OF THE INVENTION

Electrophotographic ("EP") printing involves transferring toner, or dry ink, to a substrate, such as paper, by means of an electric field and then fusing the toner to the substrate using a combination of heat and pressure. After fusing, the substrate is cooled, and excess charge is removed from the substrate. Conventionally, a release fluid is used during the fusing process to provide release of the substrate from the fusing roller. After fusing, cooling, and removing excess charge, the substrate exits the EP printing device, thereby completing the printing process. The substrate having an image fused thereon by an EP printing process is referred to as a "printed document" and may contain text, one or more images, or both. The low and medium density EP images are typically comprised of a halftone pattern of "dots" of individual dry ink particles. Image density increases as the amount of substrate covered by the dot pattern increases.

Commonly, the printed document subsequently is subjected to a finishing procedure. Examples of finishing procedures-include glossing, coating using ultraviolet ("UV") radiation, and lamination. In the case of glossing, the printed document is subjected to a procedure that heats and casts the fused toner on the printed document to give it a glossy appearance. In the case of coating using UV radiation, the printed document is coated with a UV curable fluid and exposed to such UV radiation. In the case of lamination, a coating, such as plastic, is applied to the printed document and is heated under pressure to form a protective coating over the printed document.

For proper glossing, dry ink laydown must be continuous or offset will occur at the edges of the images. To that end, an inverse mask that applies more clear dry ink where there is less (or no) image is used. This results in continuous and thick layer of dry ink over the entire surface of print to be glossed.

The high gloss surface is generated by contact between a very smooth belt and a fused image in such a manner that sufficient heat is transferred to the image to cause it to completely conform to the smooth belt.

SUMMARY OF THE INVENTION

Often times the glossing process results in an image artifact consisting of locally lighter image a fixed distance from the lead edge as a print is glossed. This artifact is most visible in areas of medium but consistent image. The present invention provides methods for reducing this artifact.

These and other aspects, objects, features and advantages of the present invention will be more clearly understood and appreciated from a review of the following detailed description of the preferred embodiments, the Figures, and appended claims.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

DETAILED DESCRIPTION OF THE INVENTION

Figure 1:
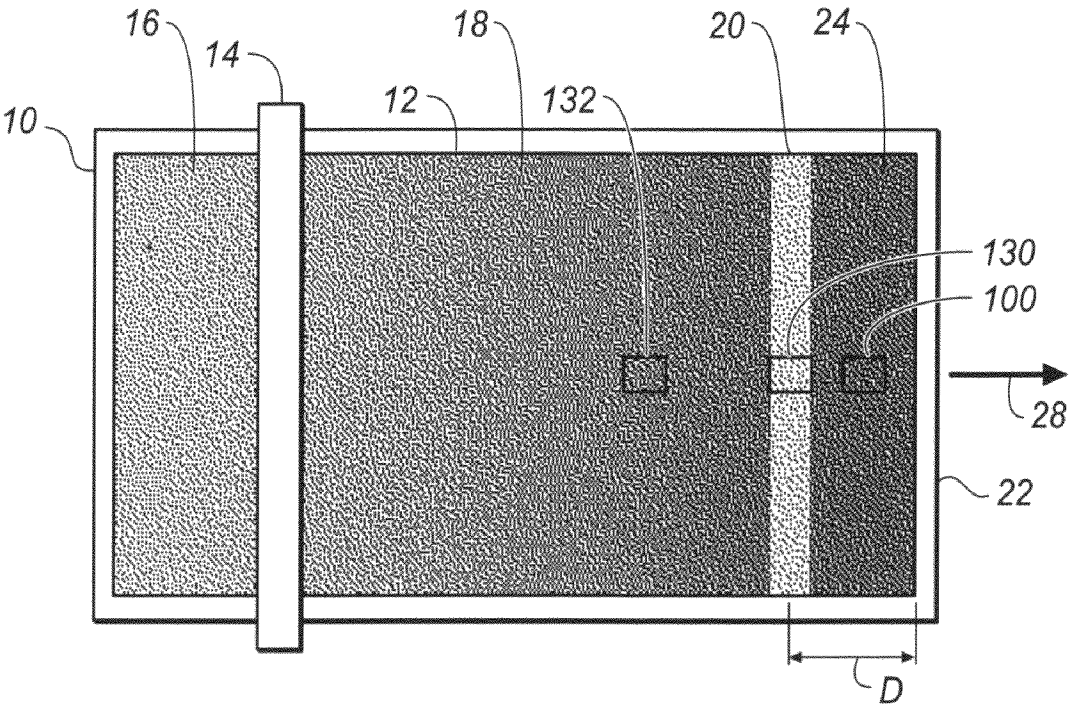
FIG. 1 shows a receiver having a printed image in an incorporated or independent glosser.

For simplicity and illustrative purposes, the principles of the present invention are described by referring to various exemplary embodiments thereof. Although the preferred embodiments of the invention are particularly disclosed herein, one of ordinary skill in the art will readily recognize that the same principles are equally applicable to, and can be implemented in other systems, and that any such variation would be within such modifications that do not part from the scope of the present invention. Before explaining the disclosed embodiments of the present invention in detail, it is to be understood that the invention is not limited in its application to the details of any particular arrangement shown, since the invention is capable of other embodiments. The terminology used herein is for the purpose of description and not of limitation. Further, although certain methods are described with reference to certain steps that are presented herein in certain order, in many instances, these steps may be performed in any order as would be appreciated by one skilled in the art, and the methods are not limited to the particular arrangement of steps disclosed herein.

The basic mechanism for increased image density (in general or localized) as a print is passed through the glosser is image smear. The glosser can be a stand alone glosser or be incorporated into the printer or even be a separate station or printing module in a printer. As the image dot pattern is smeared, less of the substrate is exposed so that image density is increased. Dry ink image smear may be caused by the combination of at least 5 factors.

The first is dry ink coverage. Since offset will occur in the glosser at the edges of any image, dry ink coverage must be continuous. The second factor is the glosser pressure roller is driven by the heater roller through the belt, dry ink and paper or in reverse order. Since shear resistance of the dry ink is less than that of the other layers, especially when the dry ink is melted, the force required to rotate the pressure roller will shear the dry ink as the print is glossed. The third factor is differences in the level of shearing within the dry ink layer as the area coverage and thickness of the dry ink layer changes. The maximum change in dry ink area coverage occurs as the image first enters the glosser nip. The fourth factor is growth of the substrate as it passes through the glosser nip, due to thermal expansion. The fifth factor is the tendency of the substrate to stick to the belt in the immediate post nip area, where the dry ink is at its lowest viscosity and thus easiest to smear.

Taken together, these 5 mechanisms generate image smear that increases image reflection density and color hue. As the sum of the mechanisms change due to changes in levels of the above factors, the magnitude of the changes in density and color hue will also change. This results in locally lighter or darker images which can be unacceptable in terms of image quality. The following figures show examples of the effects of a differential image smear in a series of photomicrographs at about 50× magnification.

FIG. 1 represents a receiver 10 that has a printed image 12 that is passing through a glosser nip 14 so that there is an as-printed density of print 16 and an as-glossed density 18 (shown here as increased from as-printed 16 portion) and a reduced as glossed density portion 20 (shown here as a reduced as-glossed image density from the as-printed 16 portion). This is also known and referred to herein as an artifact 20. Finally near the front edge 22 there is an as-glossed image density portion 24 which has a further increased density from the as-printed portion 16. The receiver is shown moving from left to right as represented by the arrow or direction of movement 28. The distance "D" represents the distance the artifact appears from the front edge which is discussed in more detail later in this description and which is represented in the result tables determined from experimentation.

The specific local change in image density 100 is a cross track band of increased image density adjacent to the image lead edge 110 (as it is fed through the glosser 120 in the direction indicated by the arrow) as seen in FIG. 1.

Figure 2:
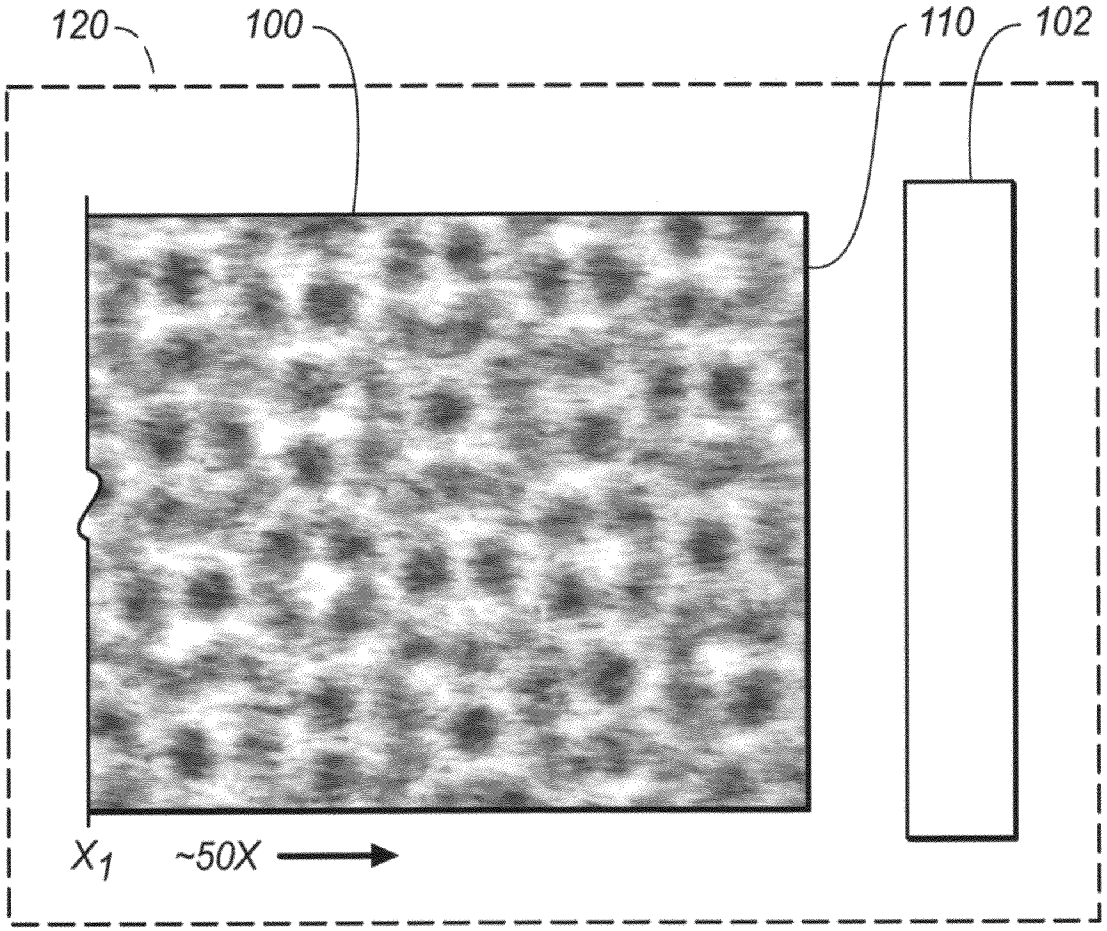
FIG. 2 shows an example of glosser image smear close to the lead edge of the image.

FIG. 2 is a 50× size photomicrograph of the area designated in area 1. FIG. 2 shows the area of smearing that causes the increased image density shown in FIG. 1.

Figure 3:
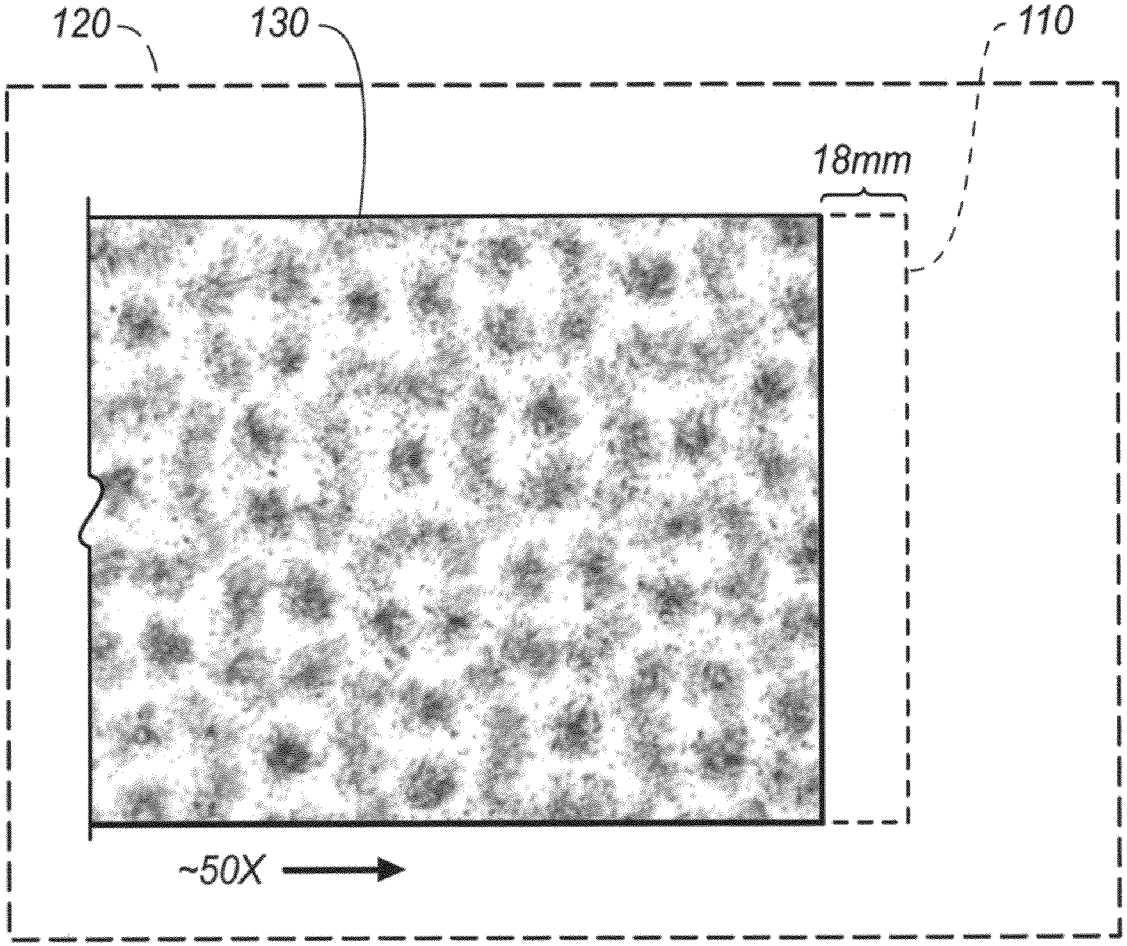
FIG. 3 show image smear in the area where the artifact appears.

FIG. 3 is a 50× size photomicrograph showing an area 130 of lower reduced as-glossed image density as shown in FIG. 1 that is shown as artifact 20.

Figure 4:
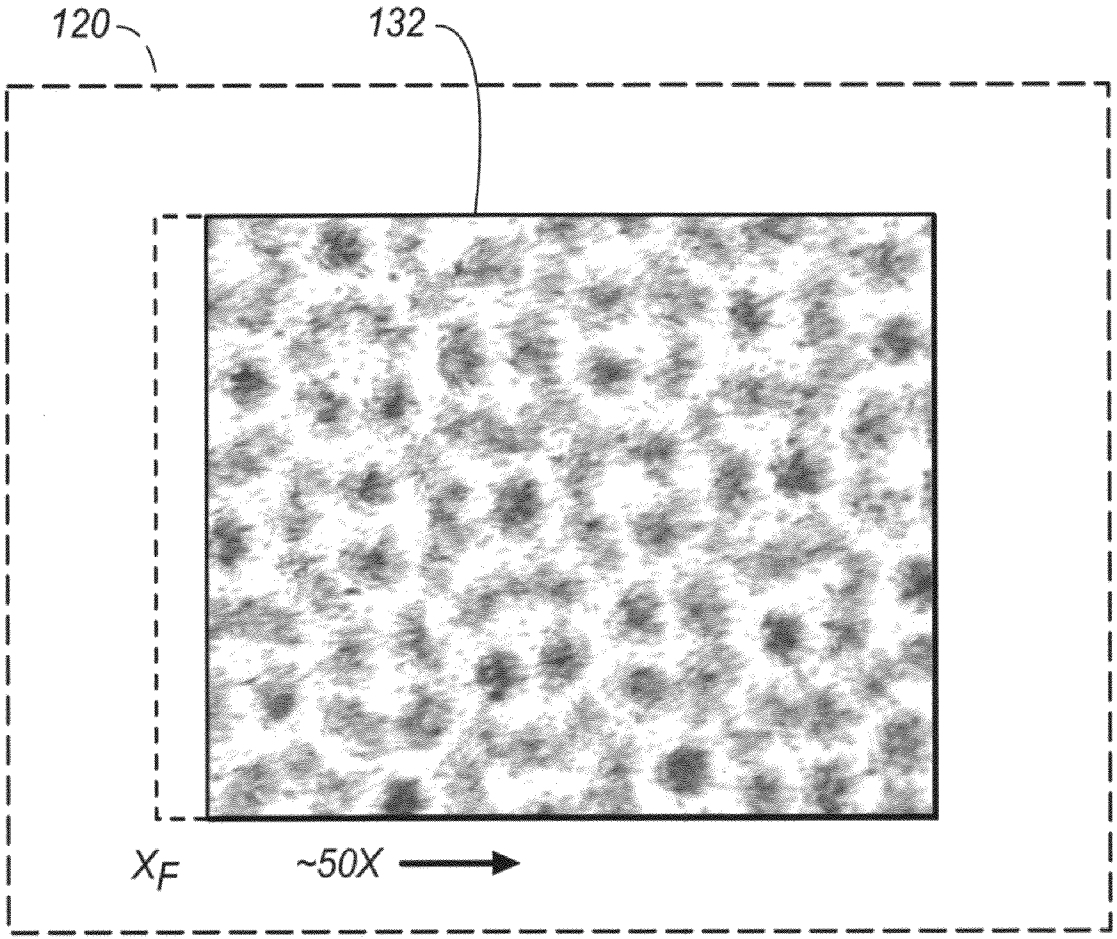
FIG. 4 shows the image smear for the balance of the print.

FIG. 4 is a 50× size photomicrograph showing an area of increased as-glossed image density as shown in FIG. 1.

Figure 5:
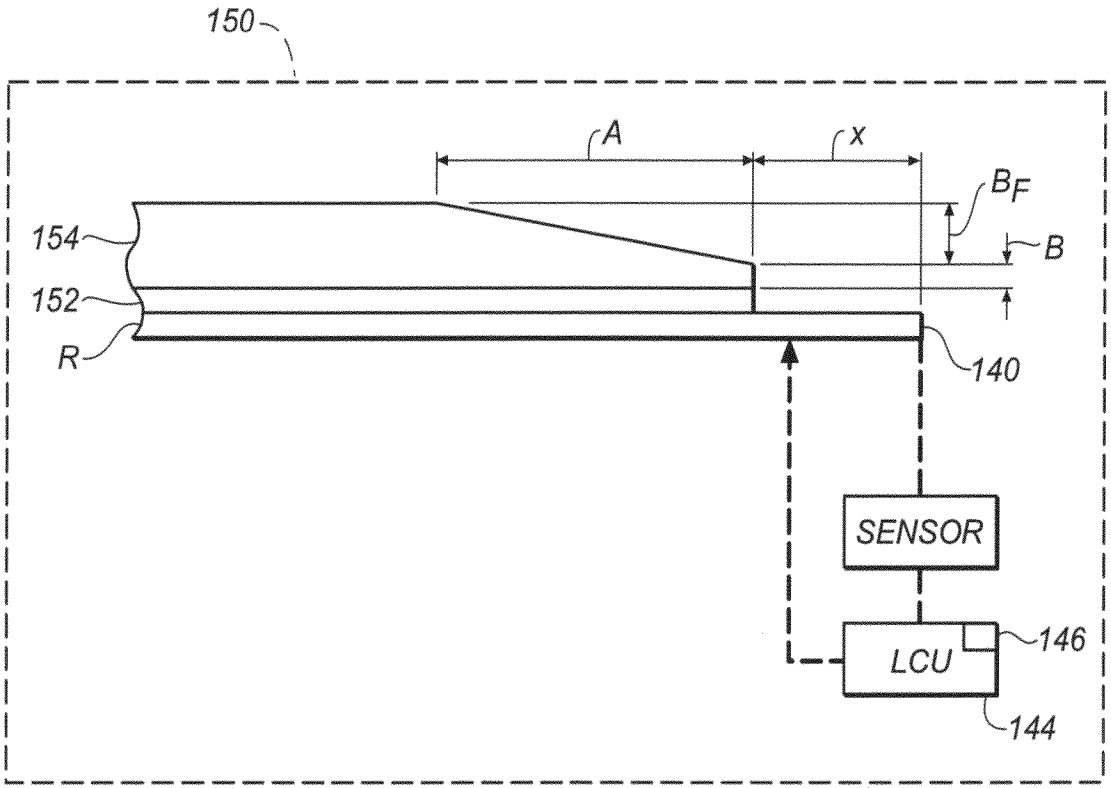
FIG. 5 shows a diagram used in a designed experiment to determine the relationship between the level of the defect and reduction of clear dry ink to the edge of an image in accordance with one embodiment of the present invention.

FIG. 5 shows one embodiment of the invention that is described in more detail below. FIG. 5 shows a receiver R having a leading edge 140 that can be detected by a sensor "S" in the printer which is a well known distance x from the image edge by techniques known to those skilled in the art. A distance "A" can be predetermined to cover the areas that a smear will occur in a particular printer 144 or, alternately, one or more sensors used to detect an image edge or similar boundary where gloss is desired and a blurred image could occur. These distances can be stored in and accessible tables for the printer memory 146.

The changes in image density described are most visually apparent in areas of consistent, medium image density. The present inventors have discovered that to reduce this effect, the print may be fed through the glosser so that large areas of medium density are towards the trailing edge of the print. This technique is especially preferred if medium density is only on one edge.

The present inventors have also discovered that the effect may be reduced by maximizing the length of clear dry ink in the in-track dimension before the image passes through the glosser nip. To accomplish this, the image should be printed on a larger size paper than the image and the image should be biased towards the lead or the trailing edge as the print passes through the press. Then the other edge should be fed through the glosser first. If the length of clear dry ink (before the image) on the print as it passes through the glosser is 28 mm or more, the differential smear will occur entirely on the clear dry ink and will not be visible. It should be noted that this embodiment requires a secondary trimming operation.

The present inventors have also discovered that the artifact may be reduced by decreasing the glosser temperature. This reduces melting of the dry ink and hence the level of smearing. Unfortunately, image gloss also decreases. The density of the image can also be locally increased or decreased during the EP printing process to compensate for the expected image smear during glossing. In other words, dry ink laydown can be decreased in areas where increased smear is expected and increased in areas where less smear is expected. This technique requires prior knowledge that the print will be glossed and which edge of the print will be fed through the glosser first. One method of glossing is described in the co-owned patent, U.S. Pat. No. 7,139,521 entitled Gloss and differential gloss control methodology which is incorporated by reference.

It has also been discovered that decreasing the maximum amount of clear dry ink at the edges of the image and then gradually increasing the amount of clear dry ink reduces the effect. The amount of clear dry ink laydown may be decreased to 5%-50% at the edges and then gradually increased to levels typically used in printing methods. The laydown percentages are in comparison to a laydown which is a machine determined density volume of toner per unit area to achieve complete coverage known to those skilled in the art.

Alternatively, the amount of clear dry ink laydown may also be decreased to 10%-25% at the edges and then gradually increased to levels typically used in printing methods. Decreasing the maximum amount of clear dry ink at the edges of the image to 15% and gradually increase to the typical 90% over a length of 30 mm has been shown to produce desirable results. This process requires no intervention or subsequent operations.

EXAMPLE 1

Several screen tests were performed to better characterize and understand the defect, which consisted of a cross track area of lower image density that occurred a certain distance from the lead edge of prints from a Kodak NexPress® 2100 plus digital production color press as each was fed through a Kodak NexGlosser® glossing unit.

Factors that had no effect on the defect level were time between printing and glossing, decreased glosser nip width in conjunction with increased glosser temperature, reduced print width, glosser pressure roller cushion thickness and durometer, and glosser pressure roller sleeve material.

The level of the defect was decreased as glosser temperature or nip width was decreased, but this also decreased image gloss below the lower specification limit. The level of the defect was also decreased as the level of clear dry ink was decreased, but this increased print image graininess as the area of each particle of color dry ink was increased in the glosser nip.

Two screen tests clearly showed the defect was caused by relative motion between the glosser belt and the image. Changing the distance between the lead edge of the paper and the lead edge of the image indicated the defect was always a fixed distance (about 18 mm) from the start of the image and not from the lead edge of the paper. In addition, intermittently pulling on the trail edge of print as it passed through the glosser created a similar type of defect that this invention can correct. Photomicrographs of the defect showed the defect was caused by differential smearing of the dry ink. FIG. 2 shows a typical level of image smear of a medium density image as the image first enters the glosser nip 102 as described in co-owned patents U.S. Publication No. 2007/0280758 published on Dec. 6, 2007 in the name of Andrew Ciaschi et al, and U.S. Pat. No. 7,236,734 each of which are hereby incorporated by reference. FIG. 3 shows the reduction in image smear as the image is further fed into the glosser nip. FIG. 4 shows the level of image smear for the balance of the print, as glossing is completed. The difference in image smear, between FIG. 3 and FIGS. 2 and 4 causes the difference in image density of the defect that shows up as an artifact.

Taking all the above screen tests into consideration, the best approach to reduce the defect level without unacceptable side effects and without glosser operator intervention was to reduce the level of clear dry ink, but only in the area where the defect occurred. Thus, the increased graininess would be limited to that area. In addition, the reduction in clear dry ink must be gradual, to avoid differential gloss between levels of clear dry ink. Since the defect occurs on the lead edge of the print as it is fed through the glosser and printing and glossing are independent processes, the gradual reduction in clear dry ink must be performed on all sides of the print that could become the lead edge when the print is fed through the glosser.

EXAMPLE 2

Two designed experiments compared the level of defect to the amount of clear dry ink reduction and the distance from the lead edge of the image over which the reduction occurred. The level of defect was subjectively determined, but could have been measured using reflective density measurements with differences in level based on a "just noticeable difference" in defect level. The smaller the level of defect, the less visible the defect to an observer. FIG. 4 shows a side view of a receiver R in a glosser (or printer with the ability to laydown clear toner, such as an incorporated glosser) 150 with an image 152 covered by clear ink 154 of varying thickness. The height of the clear ink at the front edge of the image is "B" which is increased over a distance (A) of to a final height of $B_F$ so that there is a reduced laydown over the potentially smearable portions of the image as shown.

There were two judges ("1" and "2") for the first experiment. Table 1 shows the results of the first experiment, in the order in which they were run. Table 2 shows the same results, converted to a matrix of distance and reduction.

TABLE 1

| | | | Defect Level (STB) | |
|---|---|---|---|---|
| "Run" | A | B | 1 | 2 |
| 1 | 15 | 0 | 6 | 6 |
| 2 | 15 | 45 | 6 | 6 |
| 3 | 20 | 15 | 4 | 5 |
| 4 | 20 | 30 | 4 | 5 |
| 5 | 25 | 15 | 3 | 2 |
| 6 | 25 | 30 | 3 | 3 |
| 7 | 30 | 0 | 1 | 1 |
| 8 | 30 | 45 | 2 | 4 |
| Baseline | 0 | 90 | 5 | 5 |

TABLE 2

| | | A | | | |
|---|---|---|---|---|---|
| | | 15 | 20 | 25 | 30 |
| B | 0 | 6, 6 | | | 1, 1 |
| | 15 | | 4, 5 | 3, 2 | |
| | 30 | | 4, 5 | 3, 3 | |
| | 45 | 6, 6 | | | 2, 4 |

The results of the first experiment defined the levels of the second experiment, as shown in Table 3, in the order in which they were run. There was only one judge of the results of the second experiment. Table 4 shows the same results, converted to a matrix of distance and reduction.

TABLE 3

| "Run" | A | B | Defect Level (STB) |
|---|---|---|---|
| 1 | 25 | 0 | 1 |
| 2 | 25 | 15 | 1.5 |
| 3 | 25 | 30 | 2 |
| 4 | 25 | 45 | 2 |
| 5 | 30 | 0 | 1 |
| 6 | 30 | 15 | 1 |
| 7 | 30 | 30 | 2 |
| 8 | 30 | 45 | 2 |
| Baseline | 0 | 90 | 3 |

TABLE 4

| | | A | |
|---|---|---|---|
| | | 25 | 30 |
| B | 0 | 1 | 1 |
| | 15 | 1.5 | 1 |
| | 30 | 2 | 2 |
| | 45 | 2 | 2 |

The results of the second experiment showed that even though the defect level was reduced by any reduction in clear dry ink laydown near the lead edge as the print was glossed, a reduction to 15% or less over a distance of 25 or 30 mm provided the maximum reduction in defect level. Since more offset will occur as the clear dry ink laydown approaches zero, 15% was selected as the optimum level of reduction. Since the defect level increased at a distance of reduction of 20 mm per the first experiment, 30 mm was selected as the optimum distance of reduction.

The invention has been described in detail with particular reference to certain preferred embodiments thereof, but it will be understood that variations and modifications can be effected within the spirit and scope of the invention.

What is claimed is:

1. A method for creating a dry ink print; comprising:

forming a dry ink image having a colored dry ink on a substrate and a clear dry ink over the colored dry ink and the substrate; and passing the substrate and the dry ink image through a nip the between a first moving surface that contacts a side of the receiver having the dry ink image and second moving surface that contacts an opposite side of the receiver and operating at least one of the first moving surface and the second moving surface to create a first shear in the colored dry ink causing a first smearing of the dry ink against the substrate beginning at a first edge of the dry ink image that enters the nip and that creates a second shear in the dry toner image after a length of the dry ink image has passed through the nip causing a second smearing of the dry ink against the substrate;

wherein there is a first laydown of dry ink within the length of the dry ink image and a second laydown of dry ink after the length of the dry ink image and wherein the first laydown is decreased from the second laydown so that the first smearing is more consistent with the second smearing.

2. The method of claim 1 wherein an amount of clear dry ink laydown in the first laydown is gradually increased from a lower level proximate to the first edge to clear dry ink laydown in the second laydown.

3. The method as in claim 2 wherein the maximum amount of clear dry ink laydown at first edge of the dry toner image is decreased to 15% of the second level and gradually increasing the clear dry ink laydown to 90% over a length of 30 mm from the front edge.

4. The method of claim 1, wherein that an amount of clear dry ink laydown at the first edge of the dry ink image is decreased to between 5 and 50% of a clear dry ink laydown in the second laydown.

5. The method of claim 1, wherein the amount of clear dry ink laydown proximate the first edge of the dry ink image is decreased to about 10% to 25% of the clear dry ink laydown in the second laydown.

6. The method of claim 1 wherein an amount of clear dry ink laydown at the first edge of the dry ink image is decreased to 15% of the clear dry ink laydown in second laydown.

7. The method of claim 1 further comprising increasing the dry ink laydown from less than 100% of the second laydown at the first edge to 100% of the second laydown after a portion of the toner image.

8. The method of claim 1 further comprising printing the dry ink image on a larger size receiver than the image wherein the dry ink image is biased towards a first edge and wherein the receiver and dry ink image are introduced into the nip with an second edge that is opposite from the first edge entering the nip before the first edge.

9. A method for glossing; comprising:

receiving a dry ink image having a colored dry ink on a substrate and a clear dry ink over the colored dry ink having a first edge proximate to an area of the dry ink image having a consistent image reflection density and a second edge that is not proximate to an area of the dry ink image having a consistent image reflection density;

passing the substrate and the dry ink image through a nip the between a first moving surface that contacts a side of the receiver having the dry ink image and second moving surface that contacts an opposite side of the receiver and operating at least one of the first moving surface and the second moving surface to create a first shear in the colored dry ink causing a first smearing of the dry ink against the substrate beginning at a first edge of the dry ink image that enters the nip and that creates a second shear in the dry toner image after a length of the dry ink image has passed through the nip causing a second smearing of the dry ink against the substrate;

wherein the substrate is passed into the nip with the second edge positioned to enter the nip before the first edge so that the area of the dry ink image having a consistent image reflection density passes through the nip after the length has passed through the nip so that the entire area will have the second smearing.

10. A method for glossing; characterized by:

receiving a dry ink image having a colored dry ink on a substrate and a clear dry ink over the colored dry ink having a first edge proximate to an area of the dry ink image having a consistent image reflection density and a second edge that is not proximate to an area of the dry ink image having a consistent image reflection density;

passing the substrate and the dry ink image through a nip the between a first moving surface that contacts a side of the receiver having the dry ink image and second moving surface that contacts an opposite side of the receiver and operating at least one of the first moving surface and the second moving surface to create a first shear in the colored dry ink causing a first smearing of the dry ink against the substrate beginning when a leading one of the first edge or the second edge of the dry ink image enters the nip and that creates a second shear in the dry toner image when the leading one of the first edge and the second edge of the dry ink image has been moved a distance (D) past the nip causing a second smearing of the dry ink against the substrate;

wherein the substrate is passed into the nip with the second edge positioned to enter the nip before the first edge so that the area of the dry ink image having a consistent image reflection density passes through the nip after the second edge has passed through the nip so that the entire area will have the second smearing.

* * * * *